US005773751A

United States Patent [19]

Fredriksson et al.

[11] Patent Number: 5,773,751

[45] Date of Patent: Jun. 30, 1998

[54] SHELL FOR GUN WITH SMOOTH-BORE BARREL

[75] Inventors: Lennart Fredriksson, Lindesberg; Arne Wikström, Skellefteå, both of Sweden

[73] Assignee: Bofors Liab AB, Lindesberg, Sweden

[21] Appl. No.: 737,290

[22] PCT Filed: Apr. 5, 1995

[86] PCT No.: PCT/SE95/00364

§ 371 Date: Nov. 8, 1996

§ 102(e) Date: Nov. 8, 1996

[87] PCT Pub. No.: WO95/30875

PCT Pub. Date: Nov. 16, 1995

[30] Foreign Application Priority Data

May 10, 1994 [SE] Sweden ..... 9401625

[51] Int. Cl.[6] ..... F42B 12/20; F42B 14/06

[52] U.S. Cl. ..... 102/473; 102/293; 102/372; 102/521

[58] Field of Search ..... 102/293, 372, 102/373, 473, 482, 517, 520–523; 244/3.24, 3.3

[56] References Cited

U.S. PATENT DOCUMENTS

| | | | |
|---|---|---|---|
| 2,613,605 | 10/1952 | Brandt | 244/3.24 |
| 2,788,744 | 4/1957 | Donner | 102/522 |
| 3,788,230 | 1/1974 | Losfeld . | |
| 4,408,538 | 10/1983 | Deffayet et al. | 102/522 |
| 5,063,855 | 11/1991 | Diel et al. | 102/521 |

FOREIGN PATENT DOCUMENTS

| | | | |
|---|---|---|---|
| 802042 | 8/1936 | France | 244/3.3 |

*Primary Examiner*—Harold J. Tudor
*Attorney, Agent, or Firm*—Pollock, Vande Sande & Priddy

[57] ABSTRACT

A method for converting mortar shells into shells for use in smooth-bore gun barrels having an interior surface. The mortar shells include a warhead having a front end, a rear end, a tail fin, and a propellant charge. A guide casing is attached to at least the rear end of the warhead. The guide casing includes an outside surface. The guide casing supports at least the rear end of the warhead and is adapted for use with the smooth-bore gun barrel that the converted shells are to be fired from. A bourrelet is attached to the outside surface of the guide casing for sealing between the converted shells and the interior surface of the smooth-bore gun barrel that the converted shells are to be fired from.

17 Claims, 2 Drawing Sheets

SHELL FOR GUN WITH SMOOTH-BORE BARREL

FIELD OF THE INVENTION

The present invention relates to a method for converting certain mortar ammunition for use as fin-stabilized, non-rotating shells in smooth-bore guns, in particular tank guns. The present invention also includes ammunition which has been converted in accordance with this method.

SUMMARY OF THE INVENTION

The present invention includes, on the one hand, a method for converting mortar shells for use as fin-stabilized, non-rotating shells in smooth-bore gun barrels, in particular tank guns, of essentially the same caliber as the mortars for which the shells were originally intended. On the other hand, the present invention also includes method for converting mortar shells, of smaller caliber than the small-bore gun barrels, to subcaliber non-rotating shells provided with discarding sabots. The discarding sabots are separated in a known manner from the shells outside the muzzle of the gun barrel.

The invention is considered to be of great value since there is plenty of mortar ammunition in stockpiles. Also, the high-explosive mortar shells in particular have well-designed shell bodies with good fragmentation properties. At the same time, there is need for high-explosive shells for tank divisions, which generally have artillery pieces with smooth-bore barrels. Of course, the present invention also includes the converted shells and the complete rounds of which these form part.

According to the invention, the actual conversion is carried out in such a way that the warhead of the original shell is kept unchanged. The original tail fin of the shell with internal propellant charge chamber, is either replaced by a new tail fin adapted to the new and higher velocity of exit (Vo) of the projectile, or is merely deprived of its internal propellant charge. At the same time, the warhead is always provided with a guide part or guide casing which is adapted to the caliber gauge of the smooth-bore barrel in question and which is preferably provided with a bourrelet of the type regularly used as a powder gas seal in barrels of the type in question here.

In purely general terms, the ordinary tail fin of the mortar shell is usually secured on the warhead by means of a screw thread. Particularly in those cases where the tail fin is to be replaced by a new one, the the screw thread can be used for securing the guide casing on the warhead. The guide casing is, in turn, provided with a screw thread for screwing-on the tail fin.

Moreover, shells converted in accordance with the present invention are always intended to be supplemented with a propellant powder charge that is appropriate for the gun in question. In the case of tank guns, the supplemental charges generally involves fixed propellant charges. The shells can be combined with the supplemental charge to form complete rounds.

The invention further includes two alternative possibilities for converting mortar shells for use in smooth-bore barrels. The first variant is based on mortar shells intended for mortars of the same, or essentially the same, caliber as the smooth-bore guns in which the converted shells are intended to be used. In this case, the guide casing is mainly in the form of a casing that encloses and supports the rear part of the warhead of the original shell. The inside of the casing is shaped match the outer shape of the warhead in order to increase the strength of the warhead against firing stresses. Also, the rear portion of the casing is designed to be relatively strong. Additionally, the front portion of the casing consists of an approximately tubular and relatively thin-walled portion that adjoins the outer periphery of the warhead in the vicinity of its maximum diameter. The more solid rear portion of the guide casing also includes a bourrelet groove that is provided with a conventional bourrelet.

The second variant for converting mortar shells is based on a mortar shell of smaller diameter than the gun barrel in which the converted shell is to be used. This shell is provided with a guide casing designed in accordance with the principles applying to discarding sabots for subcaliber projectiles. That is, it is designed in three or more parts in the longitudinal direction. The parts are held together by means of locking bands intended to be torn off by ram pressure when the projectile leaves the barrel. As in the first variant for converting mortar shells, the guide casing/discarding sabot in the second variant also includes a relatively strong rear portion having an inner shape adapted to the outer shape of the warhead in order to increase the strength of the warhead against the firing stresses. The rear portion also include guide grooves for a conventional bourrelet. The sabot also includes a more thin-walled front portion that expediently opens out in a cup shape at the front providing a good point of attack for the relative wind.

The method and the arrangement according to the invention, and the finished round which is obtained in accordance therewith, are defined in the attached patent claims and will now be described in somewhat greater detail in connection with the attached figures.

DETAILED DESCRIPTION OF THE INVENTION

Figure 1:
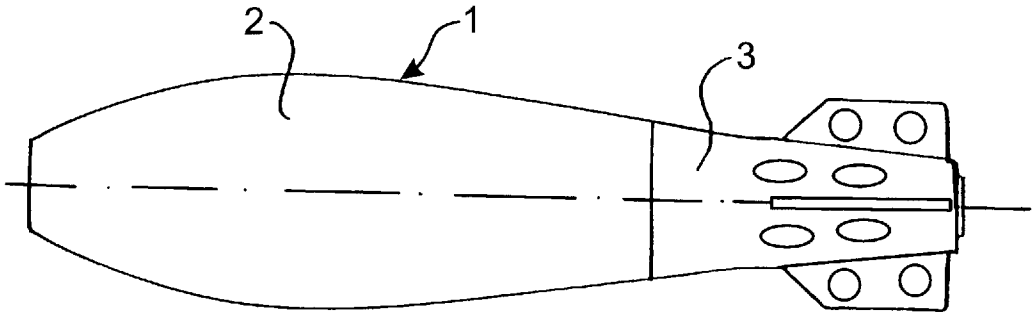
FIG. 1 shows a side view of the starting point, namely a conventional high-explosive mortar shell.
Figure 2:
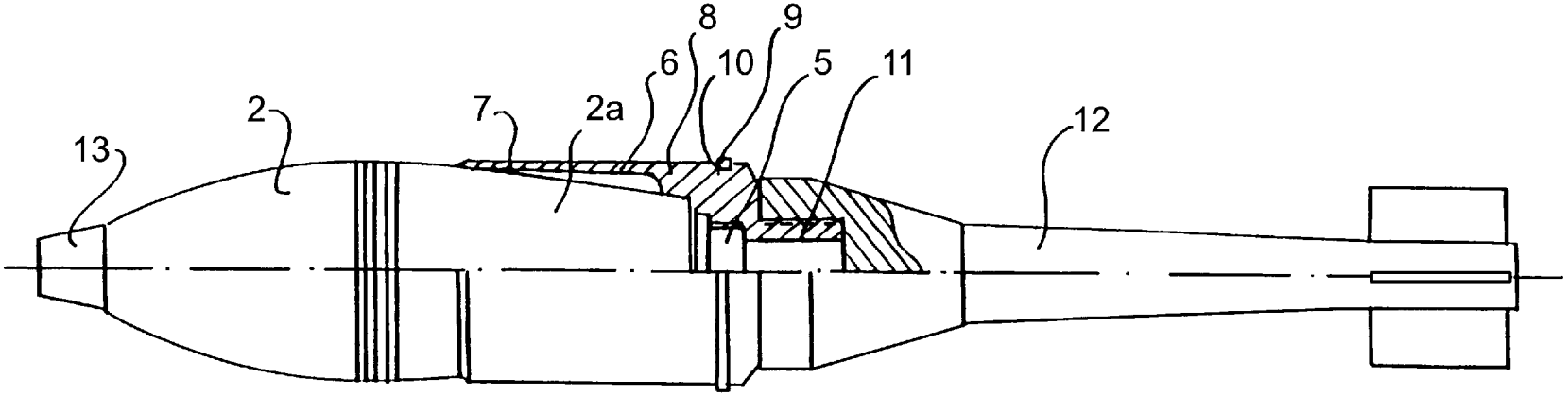
FIG. 2 shows a partially cut-away side view of the converted high-explosive shell adapted for use in unrifled gun barrels.

The mortar shell 1 shown in FIG. 1 comprises a front warhead 2, also seen in FIG. 2, and a rear tail fin 3 with inner propellant charge.

The shell 4 shown in FIG. 2 has been modified for use in unrifled barrels. The shell comprises the explosive-filled warhead 2. The tail fin 3 has been disassembled and its assembly screw thread 5 used for screwing-on of the guide casing 6. The guide casing has a relatively thin-walled, tubular front part 7, which encloses the rearwardly narrowing rear part 2*a* of the warhead 2. The guide casing also includes a rear part on which a new tail fin 12 is firmly screwed. The tail fin 12 is adapted to the new, higher exit velocity (Vo) of the converted shell. The finished shell also includes a fuse 13, which can be the original mortar fuse or a newly constructed mortar fuse.

Figure 3:
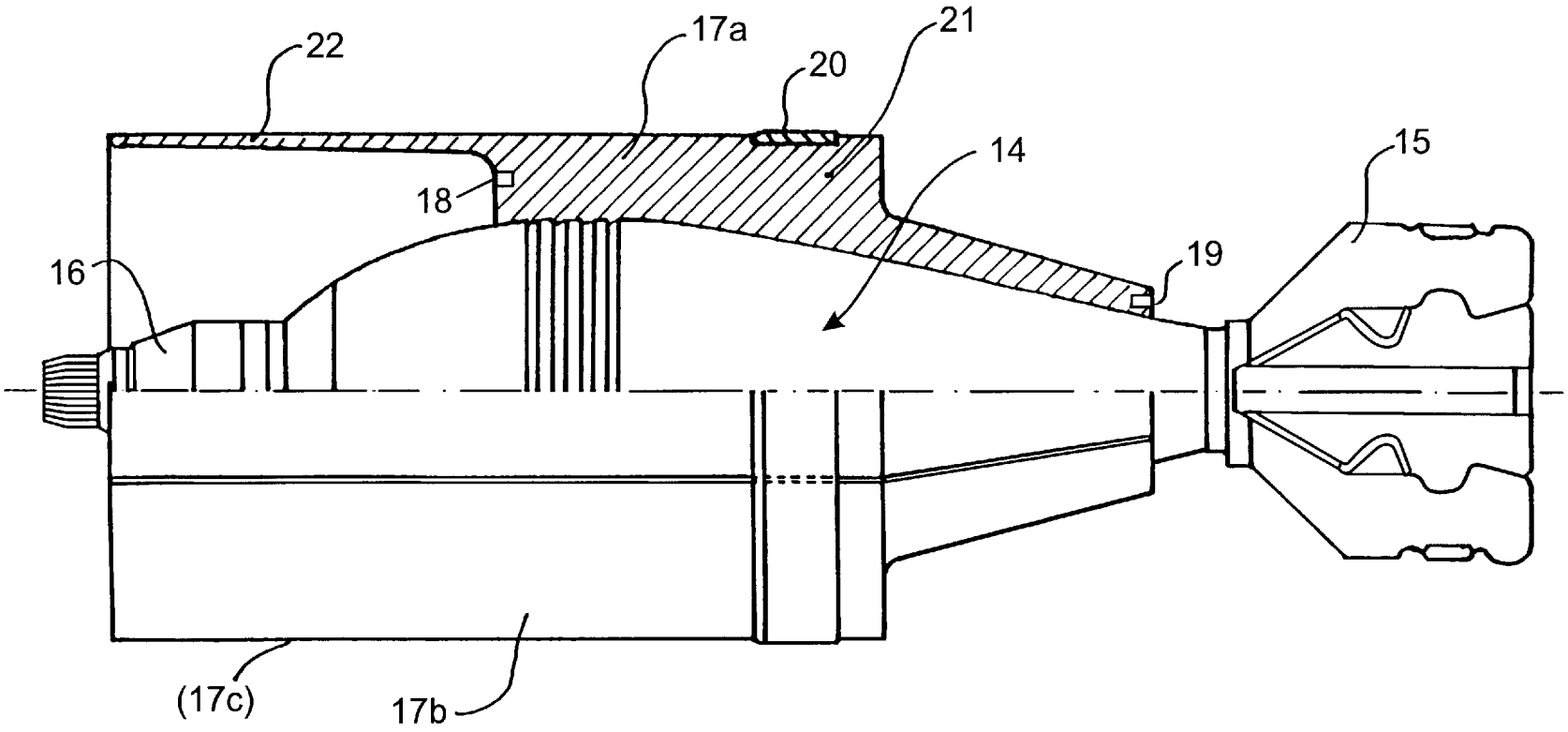
FIG. 3 shows a partially cut-away side view of a converted subcalibre-type shell provided with discarding sabot.

FIG. 3 shows the second variant of the shell according to the invention. This embodiment starts with a shell 14 having smaller caliber than the barrel it is to be used with. In this embodiment, the original tail fin 15 has been retained, but deprived of its original internal propellant charge. The fuse 16 has also been retained in its original form. In contrast, the shell has been supplemented with a discarding sabot or a guide casing, 17*a–c*. The sabot is longitudinally divided into three parts direction held together by connection rings 18 and 19 and also the bourrelet 20. The connection rings and bourrelet are torn off by the ram pressure when the shell leaves the barrel muzzle. Then, the discarding sabot parts separate from the shell in a known manner. The shell continues on its trajectory alone. The three parts 17*a–c* of the discarding sabot are designed in such a way that the latter has a relatively solid rear and central portion 21, which fits closely against, and supports, those parts of the original shell body which, upon firing, are exposed to the greatest stresses. The front portion 22 of the sabot parts is relatively thin-walled and opens out in a cup shape at the front around the forward part of the shell body 14, to provide a good point of attack for the ram pressure.

Shells converted according to the invention are always supplemented with a conventional propellant powder charge for the artillery piece in question.

We claim:

1. A method for converting mortar shells into shells for use in smooth-bore gun barrels having an interior surface, the mortar shells including a warhead having a front end, a rear end, a tail fin, and a propellant charge, said method comprising the steps of:

attaching a guide casing to at least the rear end of the warhead, said guide casing including an outside surface, said guide casing supporting at least the rear end of the warhead and being adapted for use with the smooth-bore gun barrel that the converted shells are to be fired from; and attaching a bourrelet to said outside surface of said guide casing for sealing between the converted shells and the interior surface of the smooth-bore gun barrel that the converted shells are to be fired from.

2. The method according to claim 1, further comprising the steps of:

removing the tail fin from the rear end of the warhead; and attaching to the rear end of the warhead a new tail fin adapted for use with increased exit velocity of smooth-bore gun barrels, said new tail fin not including a propellant charge.

3. The method according to claim 2, wherein said warhead includes a threaded portion for securing said tail fin to said warhead, said guide casing includes an inner threaded portion and a rear portion including a rearwardly projecting externally threaded cylinder, said method further comprising the steps of:

attaching said inner threaded portion of said guide casing to said threaded portion of said warhead; and attaching said new tail fin to said rearwardly projecting externally threaded cylinder of said guide casing.

4. The method according to claim 1, wherein said mortar shell is of a smaller caliber than the smooth-bore gun barrel that the converted shells are to be fired from, and said guide casing comprises a multi-part guiding sabot for adapting said smaller caliber mortar shell for use with said smooth-bore gun barrel, ram air pressure created as said converted shell passes through said smooth-bore gun barrel causing said guide casing to separate from said smaller caliber mortar shell as the converted shell passes a muzzle of the smooth-bore gun barrel.

5. The method according to claim 4, further comprising the steps of:

attaching at least one connector ring to said multi-part sabot for connecting said sabot parts together.

6. The method according to claim 1, wherein the smooth-bore gun is an artillery piece.

7. The method according to claim 1, wherein the smooth-bore gun is a tank gun.

8. A method for converting a mortar shell including a propellant charge into a shell for use in a smooth-bore gun barrel having an interior surface, said method comprising the steps of:

providing a mortar shell including a warhead having a front end, a rear end, an outer surface, and a tail fin;

providing a guide casing including an inner surface for engaging at least a portion of the outer surface of the warhead, said guide casing having an outer surface adapted to be utilized with a smooth-bore gun barrel of a caliber that the converted shell is to be utilized with;

providing a bourrelet for attaching to the outer surface of said guide casing to seal a space between the converted shell and the interior surface of the smooth-bore gun barrel that the converted shell is to be fired from;

attaching the guide casing to at least the rear end of the warhead, said guide casing supporting at least the rear end of the warhead; and attaching said bourrelet to said guide casing.

9. A converted shell converted from a form for use with a mortar and including a propellant charge to a fin-stabilized non-rotating shell for use with a smooth-bore gun barrel, said converted shell comprising:

a warhead of the mortar shell, said warhead including a front end, a rear end, and an outer surface;

a guide including an inner surface engaging at least a portion of the outer surface of the warhead, said guide having an outer surface adapted to be utilized with a smooth-bore gun barrel of a caliber that the converted shell is to be utilized with; and a tail fin attached to one of said warhead or said guide.

10. The converted shell according to claim 9, further comprising:

a bourrelet adapted to the caliber of the smooth-bore gun barrel that the converted shell is to be fired from and attached around the outer surface of said guide casing to seal a space between the converted shell and the interior surface of the smooth-bore gun barrel that the converted shell is to be fired from; and wherein said warhead narrows toward said rear end and said guide casing encloses at least said narrowing portion of said warhead, and wherein said tail fin does not include a propellant charge.

11. The converted shell according to claim 9, wherein:

said warhead includes a threaded portion for securing a tail fin of the mortar shell to said warhead;

said guide casing includes an inner threaded portion and a rear portion including a rearwardly projecting externally threaded cylinder;

said guide casing is secured to said warhead by engaging said inner threaded portion of said guide casing with said threaded portion of said warhead; and a new tail fin is attached to said rearwardly projecting externally threaded cylinder of said guide casing to replace a tail fin of the shell before conversion.

12. The converted shell according to claim 9, further comprising:

a bourrelet adapted to the caliber of the smooth-bore gun barrel that the converted shell is to be fired from and attached around the outer surface of said guide casing to seal a space between the converted shell and the interior surface of the smooth-bore gun barrel that the converted shell is to be fired from; and wherein said guide includes a collar portion having a substantially constant external diameter, a front portion of said collar being adapted to adjoin the warhead.

13. The converted shell according to claim 9, wherein said converted shell is converted for use with a smooth-bore gun of a larger caliber than the mortar that the shell was originally intended to be utilized with, said guide comprises a multi-part sabot for adapting said shell for use with said larger caliber smooth-bore gun, said sabot being separated from said warhead by ram air pressure created as said converted shell passes through said larger caliber smooth-bore gun barrel.

14. The converted shell according to claim 13, wherein said guide further comprises a cup-shaped front portion opening in a direction of firing of said converted shell, said cup-shaped portion being separated from the front end of the warhead so as to form an annular space between the cup-shaped portion and the front end of the warhead.

15. The converted shell according to claim 13, further comprising:

at least one connector ring to said multi-part sabot for connecting said sabot parts together.

16. The converted shell according to claim 9, wherein the smooth-bore gun is an artillery piece.

17. The converted shell according to claim 9, wherein the smooth-bore gun is a tank gun.

* * * * *